US009503819B2

(12) United States Patent
Brockmole

(10) Patent No.: US 9,503,819 B2
(45) Date of Patent: Nov. 22, 2016

(54) PROGRESSIVE AUDIO BALANCE AND FADE IN A MULTI-ZONE LISTENING ENVIRONMENT

(71) Applicant: HARMAN INTERNATIONAL INDUSTRIES, INC., Stamford, CT (US)

(72) Inventor: Jeffrey M. Brockmole, Brighton, MI (US)

(73) Assignee: Harman International Industries, Inc., Stamford, CT (US)

( * ) Notice: Subject to any disclaimer, the term of this patent is extended or adjusted under 35 U.S.C. 154(b) by 0 days.

(21) Appl. No.: 14/427,886

(22) PCT Filed: Sep. 13, 2013

(86) PCT No.: PCT/US2013/059708

§ 371 (c)(1),
(2) Date: Mar. 12, 2015

(87) PCT Pub. No.: WO2014/043501

PCT Pub. Date: Mar. 20, 2014

(65) Prior Publication Data

US 2015/0256934 A1 Sep. 10, 2015

Related U.S. Application Data

(60) Provisional application No. 61/700,881, filed on Sep. 13, 2012, provisional application No. 61/706,121, filed on Sep. 26, 2012.

(51) Int. Cl.
*H04R 5/04* (2006.01)
*H04S 7/00* (2006.01)

(52) U.S. Cl.
CPC ..... *H04R 5/04* (2013.01); *H04S 7/302* (2013.01); *H04S 7/307* (2013.01); *H04R 2499/13* (2013.01); *H04S 2400/01* (2013.01); *H04S 2400/13* (2013.01)

(58) Field of Classification Search
CPC ..... H04R 5/04; H04S 7/307; H04S 2400/01; H04S 2400/13
USPC ..... 340/435; 381/57, 59, 86, 107, 123, 302, 381/303, 307
See application file for complete search history.

(56) References Cited

U.S. PATENT DOCUMENTS 5,073,944 A * 12/1991 Hirasa ..... H04B 1/20 381/102
5,661,811 A * 8/1997 Huemann ..... H04R 5/04 381/309

(Continued)

FOREIGN PATENT DOCUMENTS

CN 1642363 A 7/2005
CN 1770928 A 5/2006

(Continued)

OTHER PUBLICATIONS

International Search Report for PCT/US2013/059708, Completed by the European Patent Office on Nov. 29, 2013, 3 Pages.

(Continued)

*Primary Examiner* — Gerald Gauthier
(74) *Attorney, Agent, or Firm* — Brooks Kushman P.C.

(57) ABSTRACT

A system or method for controlling speaker acoustic output in a multi-speaker audio system having multiple listening zones include substantially simultaneously adjusting gain and at least one additional parameter, such as filtering and/or other signal processing parameters of at least a first speaker relative to at least a second speaker in response to a change in balance and/or fade settings of the audio system across a range of balance and fade settings except for a maximum or minimum setting, and muting at least one speaker in response to the maximum or minimum balance or fade setting.

16 Claims, 7 Drawing Sheets

(56) References Cited

U.S. PATENT DOCUMENTS 5,901,231 A * 5/1999 Parrella ..... H04R 17/00 381/152
6,009,178 A * 12/1999 Abel ..... H04R 5/04 381/1
6,778,073 B2 * 8/2004 Lutter ..... G08G 1/166 340/10.1
7,039,196 B1 * 5/2006 Becker ..... H04S 3/002 381/86
7,190,799 B2 * 3/2007 Bray ..... H04B 1/20 381/119
7,200,239 B2 * 4/2007 Yabe ..... H04S 7/00 381/104
7,305,097 B2 * 12/2007 Rosen ..... H04S 7/30 381/119
7,440,578 B2 * 10/2008 Arai ..... A47C 7/72 381/17
7,447,321 B2 * 11/2008 Furge ..... H04S 3/02 381/119
7,526,093 B2 * 4/2009 Devantier ..... H04R 5/02 381/300
8,031,880 B2 * 10/2011 Holmi ..... H04S 7/307 381/101
8,073,169 B2 * 12/2011 Rosen ..... H04S 7/00 381/119
8,090,116 B2 * 1/2012 Holmi ..... H04R 5/02 381/1
8,654,995 B2 * 2/2014 Silber ..... H04B 1/207 381/123
2002/0076066 A1 6/2002 Yabe et al.
2005/0100174 A1 * 5/2005 Howard ..... B60R 11/0217 381/86
2005/0213786 A1 * 9/2005 Kerneis ..... H04R 5/02 381/302
2009/0190787 A1 * 7/2009 Pieklik ..... H04R 1/023 381/386
2010/0278346 A1 11/2010 Hogue et al.
2011/0081024 A1 4/2011 Soulodre
2012/0057725 A1 3/2012 Nakamura
2013/0279706 A1 * 10/2013 Marti ..... G06F 3/165 381/57
2015/0098590 A1 * 4/2015 Oswell ..... H04R 3/04 381/120
2015/0256934 A1 * 9/2015 Brockmole ..... H04S 7/302 381/303

FOREIGN PATENT DOCUMENTS

CN 101027939 A 8/2007
CN 102385888 A 3/2012

OTHER PUBLICATIONS

Office Action from corresponding European Application No. 13 767 207.7, dated Mar. 14, 2016, 4 pages.
Office Action from corresponding Chinese Application No. 201380047727.9, dated May 18, 2016, 9 pages.

* cited by examiner

EXAMPLE RELATIVE GAINS (dB) APPLIED AT END OF BAL/FADE CONTROL RANGES IN PRIOR ART SYSTEM

| | SUB @ 20Hz | LEFT FRONT WOOFER @ 100Hz | RIGHT FRONT @ 100Hz | LEFT FRONT MID @ 1kHz | RIGHT FRONT MID @ 1kHz | LEFT REAR MID @ 1kHz | RIGHT REAR MID @ 1kHz | CENTER MID @ 1kHz |
|---|---|---|---|---|---|---|---|---|
| DETENT | 0.0 | 0.0 | 0.0 | 0.0 | 0.0 | 0.0 | 0.0 | 0.0 |
| FRONT | -10.4 | -8.6 | -8.6 | -0.3 | -0.3 | -30.2 | -30.0 | -0.3 |
| REAR | -3.0 | -4.0 | -4.0 | -26.7 | -27.0 | -0.2 | -0.2 | -27.3 |
| LEFT | -6.7 | -6.2 | -7.7 | -0.5 | -28.8 | -0.3 | -29.3 | -30.0 |
| RIGHT | -6.7 | -7.7 | -6.2 | -28.4 | -0.5 | -29.6 | -0.4 | -30.0 |
| FRONT LEFT | -19.2 | -15.2 | -20.2 | -0.7 | -32.0 | -35.9 | -35.8 | -37.2 |
| FRONT RIGHT | -19.1 | -20.2 | -15.2 | -31.1 | -0.7 | -36.2 | -35.6 | -37.2 |
| REAR LEFT | -9.0 | -10.0 | -10.0 | -29.7 | -30.5 | -0.4 | -31.6 | -32.8 |
| REAR RIGHT | -9.0 | -10.0 | -10.0 | -29.9 | -30.4 | -32.1 | -0.4 | -33.0 |

FIG. 4
PRIOR ART

EXAMPLE RELATIVE GAINS (dB) APPLIED AT END OF BAL/FADE CONTROL RANGES WITH INVENTION

| | SUB | LEFT FRONT WOOFER | RIGHT FRONT WOOFER | LEFT FRONT MID | RIGHT FRONT MID | LEFT REAR MID | RIGHT REAR MID | CENTER MID |
|---|---|---|---|---|---|---|---|---|
| DETENT | 0.0 | 0.0 | 0.0 | 0.0 | 0.0 | 0.0 | 0.0 | 0.0 |
| FRONT | -72.0 | 0.0 | 0.0 | -0.0 | 0.0 | -72.0 | -72.0 | 0.0 |
| REAR | -18.0 | -72.0 | -72.0 | -72.0 | -72.0 | 0.0 | 0.0 | -72.0 |
| LEFT | -18.0 | 0.0 | -72.0 | 0.0 | -72.0 | -0.0 | -72.0 | -18.0 |
| RIGHT | -18.0 | -72.0 | 0.0 | -72.0 | -0.0 | -72.0 | -0.0 | -18.0 |
| FRONT LEFT | -72.0 | 0.0 | -72.0 | 0.0 | -72.0 | -72.0 | -72.0 | -36.0 |
| FRONT RIGHT | -72.0 | -72.0 | 0.0 | -72.0 | 0.0 | -72.0 | -72.0 | -36.0 |
| REAR LEFT | -36.0 | -72.0 | -72.0 | -72.0 | -72.0 | 0.0 | -72.0 | -72.0 |
| REAR RIGHT | -36.0 | -72.0 | -72.0 | -72.0 | -72.0 | -72.0 | 0.0 | -72.0 |

PROGRESSIVE AUDIO BALANCE AND FADE IN A MULTI-ZONE LISTENING ENVIRONMENT

CROSS-REFERENCE TO RELATED APPLICATIONS

This application is the U.S. national phase of PCT Application No. PCT/US2013/059708 filed on Sep. 13, 2013, which claims the benefit of U.S. Provisional Patent Application No. 61/700,881 filed on Sep. 13, 2012 and 61/706,121 filed on Sep. 26, 2012, the disclosures of which are incorporated in their entirety by reference herein.

TECHNICAL FIELD

This disclosure relates to progressive control of fade and balance in audio systems that may be used in environments with multiple listening zones.

BACKGROUND

There are two main rationales for implementing balance and fade behavior in a multi-loudspeaker audio system. The first is to re-position the audio image within the listening space to accommodate particular user preferences. The second is to re-locate the audio to avoid disturbing listeners within certain regions of the listening space. Existing audio system implementations address either one or the other of these divergent goals but not both, leading to a non-ideal solution in each case.

Re-positioning the audio implies that the user wants to tailor the acoustic sound field to an individual preference, but still desires overall sound quality for all listeners. In this case it is essential that multiple loudspeakers remain active (albeit with different gains) so that an even timbre and proper acoustic summation is maintained throughout the listening environment. For example, if the user chooses to fade the audio to the front, it is desirable that the rear speakers continue to play at least a portion of their low-frequency content to avoid producing unintended acoustic dips within the space.

In contrast, re-locating the audio implies that the user wants to isolate or focus the audio to certain areas of the listening environment to not disturb certain listeners. In this case, the user is willing to sacrifice some total sound quality to achieve this goal. Therefore, the loudspeakers located near the undesirable listening zones may be completely muted to reduce the acoustic output experienced by those listeners to the extent possible. In some cases it is also desirable to filter the audio to remove low-frequency content due to the nature of its omni-directional propagation. This muting and filtering provides for a non-ideal listening experience to those listeners in the active zone.

In various types of audio systems, the user can adjust the left/right balance and front/rear fade from a default or detent setting within a certain range. The detent positions may be designed to provide for optimum audio output across the main listening area of an intended listening environment. Progressively changing the balance control or input progressively moves the audio output to the left or right of the listening environment by adjusting the signal processing of one or more loudspeakers relative to one another. Fade control operates in a similar fashion to progressively move the audio output toward the front or rear of the listening environment.

A simple prior-art implementation achieves this by progressively adjusting the gain on the loudspeakers in response to each adjustment of the control away from the detent or default position. When a control is at the end of its range, the affected loudspeakers will be muted. However, this may result in compromising sound quality as perceived by users in one or more listening zones. This may be particularly noticeable in applications where multiple loudspeakers may be arranged around the listening environment, and may have different frequency responses such as those associated with a woofer, mid-range, or tweeter, for example, to provide a desired spatial sound image or distribution.

One solution that maintains audio quality across the range of balance/fade settings is to modify the output of the loudspeakers by simultaneously adjusting gain, filtering, and/or other signal processing parameters in tandem with the balance and fade controls. For these applications, all of the loudspeakers may still be producing some acoustic output even when a balance and/or fade control is adjusted to a maximum or minimum setting at the end of its range. However, this effect may be inconsistent with listener expectations and result in complaints or warranty claims. For example, listeners may expect certain speakers to have zero perceptible audio output based on balance and/or fade being adjusted to their maximum or minimum positions.

SUMMARY

A system or method for controlling speaker acoustic output in a multi-speaker audio system having multiple listening zones include substantially simultaneously adjusting gain and at least one additional parameter, such as filtering and/or other signal processing parameters of at least a first speaker relative to at least a second speaker in response to a change in balance and/or fade settings of the audio system across a range of balance and fade settings except for a maximum or minimum setting, and muting at least one speaker in response to the maximum or minimum balance or fade setting.

In one embodiment, the system and method may also include adjusting the non-zero gain of a low frequency speaker, such as a subwoofer, to provide reduced non-directional acoustic output in response to the maximum or minimum balance or fade setting.

In one embodiment, balance and fade control is performed upstream of a spectral manager configured to generate speaker signals to provide a desired summation of speaker acoustic outputs within a particular listening zone.

In various embodiments, the system or method for balance and fade control is implemented within a head unit or control unit of an audio system in a vehicle having multiple speakers positioned within a vehicle cabin.

Systems and methods for controlling balance and fade according to the present disclosure may include one or more control regions or ranges surrounding the detent or default position of the balance and fade control interface. In one embodiment, a first range of balance and fade settings results in adjusting or modifying at least a first parameter, such as gain, associated with corresponding speakers within the listening environment. A second range of balance and fade settings results in adjusting or modifying at least a second parameter, such as the channel mixing, for example. The control may be implemented such that the second range adjusts both the first and second parameters, or various combinations of the second parameter and other parameters, such as frequency filtering, for example. Multiple control ranges may be provided with each range having progressive adjustments to one or more associated parameters to alter the sound field within the listening environment. In various embodiments, the multiple control ranges include a range that results in muting at least one speaker when the balance or fade is set to the last available position.

Embodiments according to the present disclosure provide various advantages. For example, the balance and fade control according to the present disclosure offers a hybrid approach that operates as expected by listeners and may reduce unnecessary complaints or warranty claims. The systems and methods of the present disclosure maintain a desired sound quality across a range of balance and fade settings except for the maximum and minimum settings, where one or more speakers are muted. In addition, the present disclosure provides a single implementation that achieves both rationales for balance and fade control without modification to existing controls that may vary based on the particular implementation of the human-machine interface (HMI). Muting of one or more speakers can be provided without an additional control, button, knob, switch, etc. The user can fine-tune the soundstage to individual preference by re-positioning the audio within the listening environment over a range of balance and fade settings using all but the maximum/minimum settings, and can also choose to reduce the audio output in certain zones of the listening environment by moving the balance and/or fade controls to the end of their range.

Operation of the balance and fade controls and the resulting audio system performance according to various embodiments of the disclosure is intuitive and can be transparent to meet user expectations. For example, many users expect some output from each of the loudspeakers with the balance and fade controls near their detent or default positions, and also assume that at least some loudspeakers will have no output as the controls reach a minimum/maximum setting at the end of their range.

The above advantages and other advantages and features associated with the present disclosure will be readily apparent from the following detailed description of the preferred embodiments when taken in connection with the accompanying drawings.

BRIEF DESCRIPTION OF THE DRAWINGS

FIGS. 2-4 illustrate operation of a prior art implementation of balance and fade control that compromises audio quality;

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ embodiments according to the disclosure.

Figure 1:
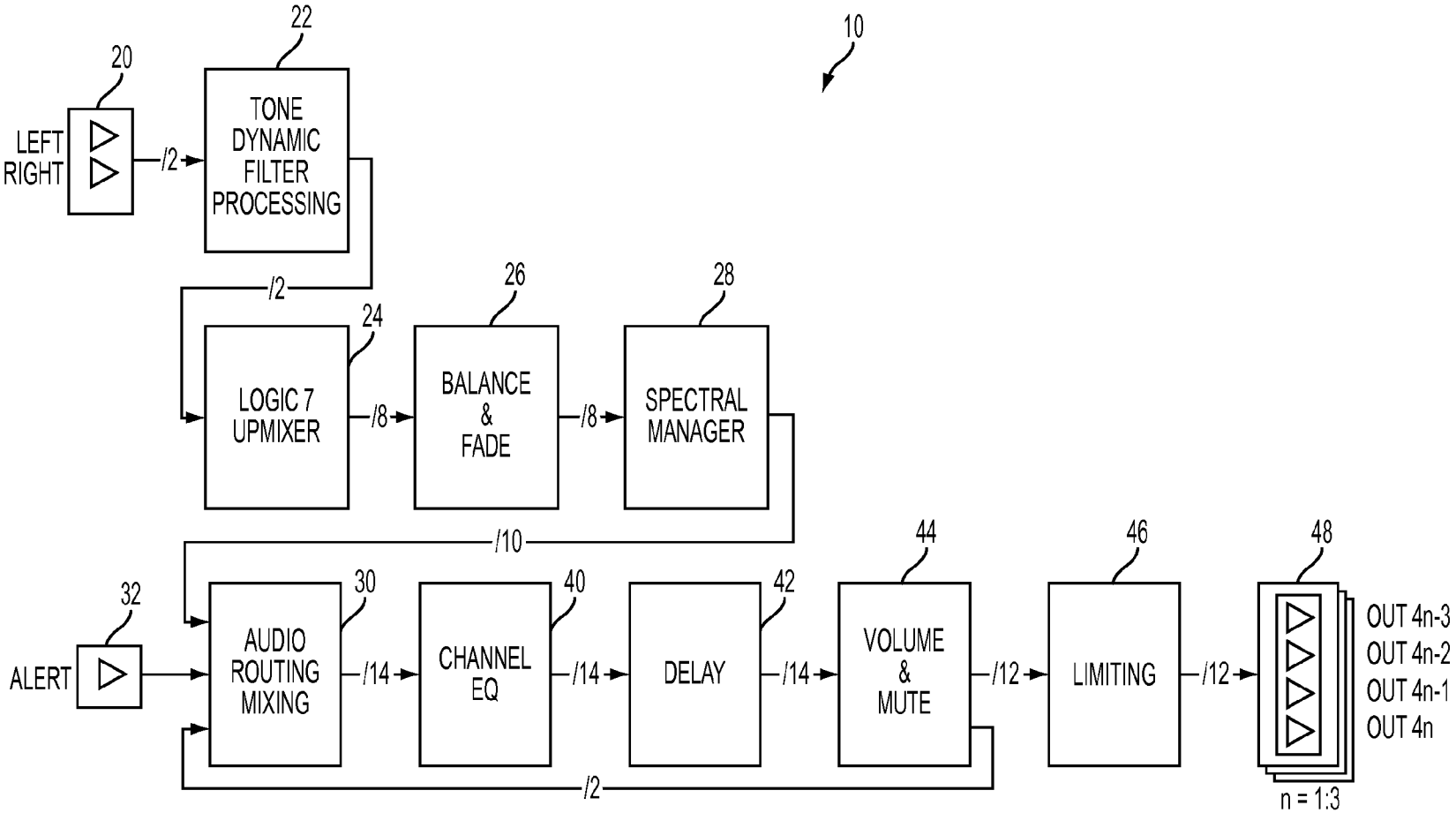
FIG. 1 is a block diagram illustrating a representative implementation of balance and fade control in an audio system according to various embodiments of the present disclosure.

Referring now to FIG. 1, a block diagram illustrating a representative implementation of balance and fade control in an audio system according to various embodiments of the present disclosure is shown. System 10 includes various functional blocks that may be implemented by hardware and/or software components within a head unit or control unit of an audio system, for example. In one embodiment, system 10 is contained within a head unit mounted in a vehicle and connected to multiple loudspeakers positioned at various locations within a vehicle cabin. Those of ordinary skill in the art will recognize that the balance and fade control embodiments of the present disclosure are generally independent of the particular listening environment and may be implemented in various types of multi-channel, multi-speaker audio systems.

In the representative embodiment illustrated in FIG. 1, system 10 receives a stereo input, generally represented at 20, that includes left and right input channels. Various other types of multi-channel inputs may be provided depending upon the particular application and implementation. Audio input generally represented at 20 is processed based on settings for tone control 22, which may include dynamic filter processing, for example. The output of dynamic filter processing block 22 is provided to an upmixer 24. In the representative embodiment illustrated in FIG. 1, upmixer 24 employs well-known Logic 7 multi-channel surround-sound technology to convert the dual channel input to multi-channel output that is provided to the balance and fade control functions as represented at block 26. Balance and fade control 26 adjusts the gain associated with at least one of the loudspeakers relative to the gain of at least one other loudspeaker in response to the user-selected balance and fade inputs to modify the perceived source of the acoustic output within the listening environment to reposition or relocate the sound field as previously described.

The adjusted multi-channel output from balance and fade control 26 is provided to spectral manager 28. Spectral manager 28 receives the multi-channel audio input signal from balance and fade control 26 and processes audio content to separate the audio content into a low-frequency portion and a mid-range and/or high-frequency portion based on one or more predetermined tunable crossover frequencies. The separated frequency portions are routed to various speakers within the audio system to provide a tunable audio field within the listening environment. In a representative vehicle environment, speakers may include left and right front speakers, one or more center speakers, left and right side speakers, left and right back speakers, and a subwoofer, for example. Front speakers may include a left front woofer, a left front mid-range, a right front woofer, and a right front mid-range. Similarly, rear speakers may include a left rear woofer, a left rear mid-range, a right rear woofer, and a right rear mid-range. The center speaker is generally implemented using a mid-range speaker. Various speakers may be optimized for producing predetermined frequency ranges. For example, a subwoofer may be optimized for producing frequencies between 20 Hz-100 Hz, whereas a woofer may be optimized for producing frequencies between 100 Hz-1 kHz, and a mid-range may be optimized for frequencies between 300 Hz-5 kHz, for example. Additional details of a representative spectral manager 28 are described in commonly owned published patent application US 2010/0278346 titled "Spectral Management System", the disclosure of which is hereby incorporated by reference in its entirety. Various other operational details of a representative system that may incorporate balance and fade control are described in commonly owned published patent application US 2011/0081024 titled "System For Spatial Extraction Of Audio Signals", which is hereby incorporated by reference in its entirety.

As illustrated by the representative block diagram of FIG. 1, the balance and fade control functions 26 may be placed upstream of spectral manager 28 to provide the user flexible and dynamic control of the sound field without significantly compromising sound quality across most settings of the balance and fade controls. The output of spectral manager 28 is provided to audio processing block 30 which operates to provide various routing and mixing functions. An additional external alert 32 may be provided as input to audio processing block 30. The output of audio block 30 is provided to a channel equalizer 40, which is then compensated for delays associated with placement of various speakers around the listening environment as represented by block 42. The output of delay compensation block 42 is provided to volume and mute control 44. Feedback from volume and mute control 44 is provided as input to audio processing block 30. Output from volume and mute control 44 is provided to power limiting block 46 with output from block 46 provided to output distribution block 48 where signals are provided to various speakers located throughout the listening environment.

As generally illustrated in the block diagram of FIG. 1, the system and associated method control speaker acoustic output in a multi-speaker audio system having multiple listening zones by substantially simultaneously adjusting gain and at least one additional parameter, such as filtering and/or other signal processing parameters of at least a first speaker relative to at least a second speaker in response to a change in balance and/or fade settings of the audio system across a range of balance and fade settings except for a maximum or minimum setting, and muting at least one speaker in response to the maximum or minimum balance or fade setting.

Figure 2A:
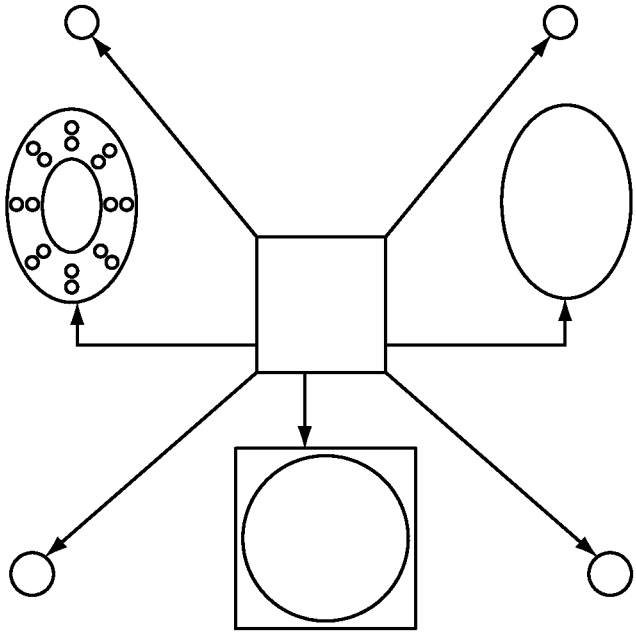
FIG. 2A PRIOR ART
Figure 2B:
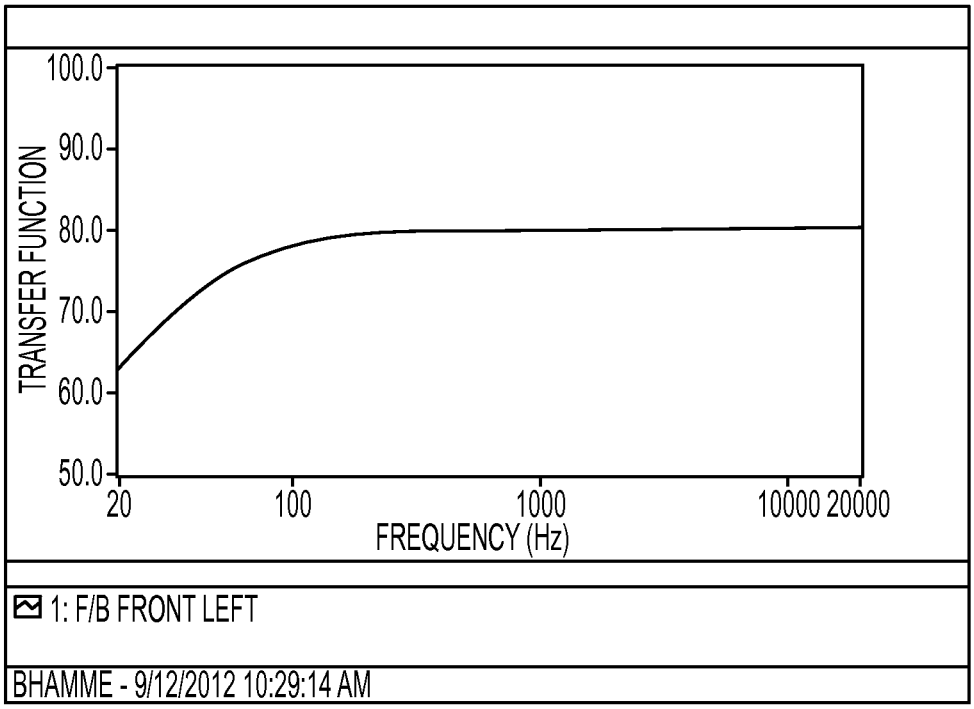
FIG. 2B PRIOR ART

FIGS. 2A and 2B illustrate operation and performance of a prior art audio system in a exemplary vehicle application. As shown in FIG. 2A, the fade and balance controls are set so that the front left speakers are operational while the remaining speakers of the vehicle are muted. This results in an unbalanced frequency response as generally illustrated in FIG. 2B with lower frequencies that would otherwise also be provided by the right woofer and omnidirectional subwoofer attenuated more significantly than frequencies above about 200 Hz. The unbalanced frequency response illustrated in FIG. 2B results in reduced audio quality.

Figure 3A:
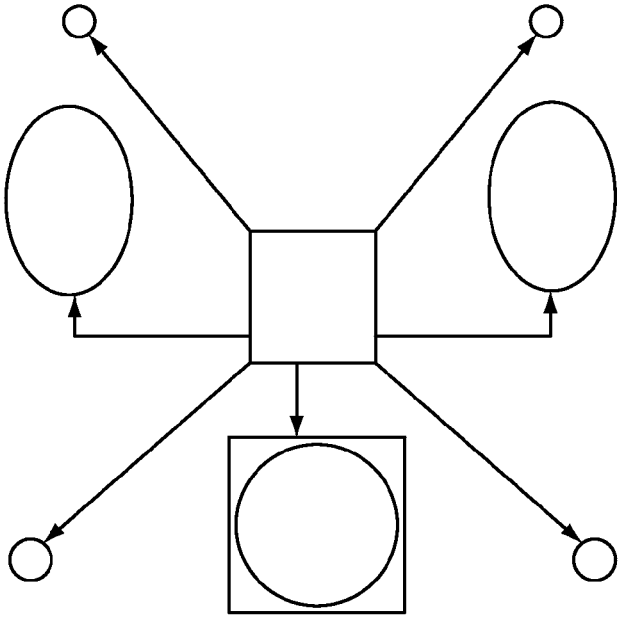
FIG. 3A PRIOR ART
Figure 3B:
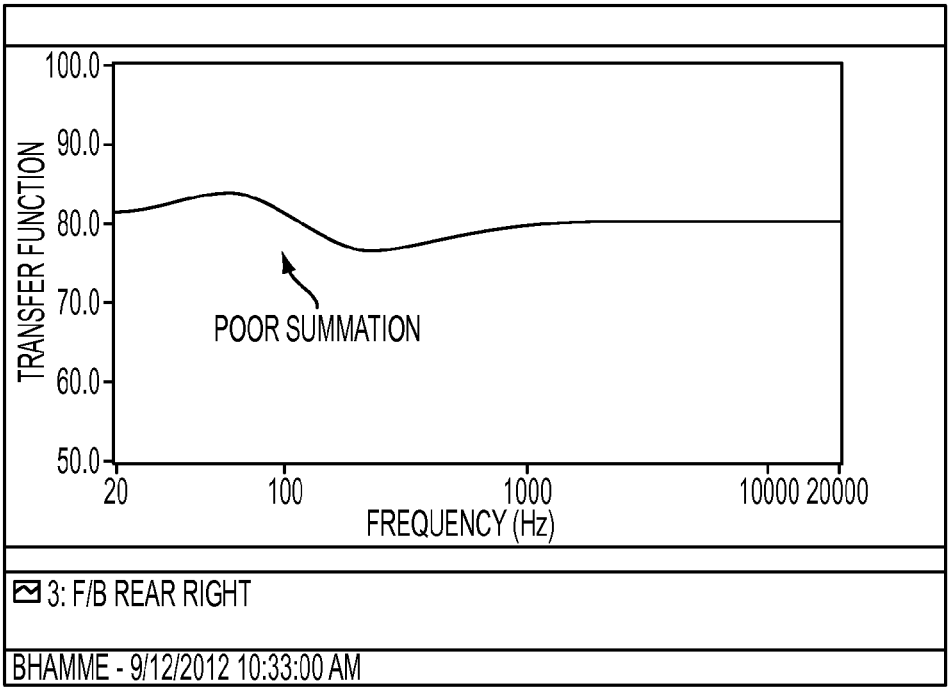
FIG. 3B PRIOR ART

FIGS. 3A and 3B similarly illustrate operation and performance of a prior art audio system in an exemplary vehicle application. As shown in FIG. 3A, the fade and balance controls are set so that the right rear speakers are operational while the remaining speakers of the vehicle are muted. This results in poor summation of the frequencies generated by the operational speakers as generally illustrated in FIG. 3B. Because the subwoofer is also operational, the frequency response at the lower frequencies up to about 80 Hz exhibits a higher gain than frequencies between about 100 and 300 Hz. This unbalanced frequency response results in reduced audio quality.

FIG. 4 is a chart illustrating relative gains applied at the minimum/maximum settings of a representative prior art system. The detent position of the balance and fade control is illustrated in the first row of FIG. 4 with balanced attenuation or gain across all speakers in the system. The first row represents balance and fade settings adjusted to attenuate the rear speakers. This is illustrated by the relative attenuation or gain values for the left rear mid-range and right rear midrange speakers. Similarly, each row in the table of FIG. 4 represents a maximum or minimum setting for the balance and fade controls to adjust the sound field to the front, rear, left, right, front left, front right, rear left, and rewrite position of the listening environment, respectively. As illustrated in FIG. 4, the maximum/minimum settings applied at the end of the balance and fade control ranges of the representative prior art system do not completely mute speakers that are not associated with a particular listening zone. For example, the rear right listening zone attenuates the left rear and center midrange speakers although they will still provide a perceptible acoustic output.

Figure 5A:
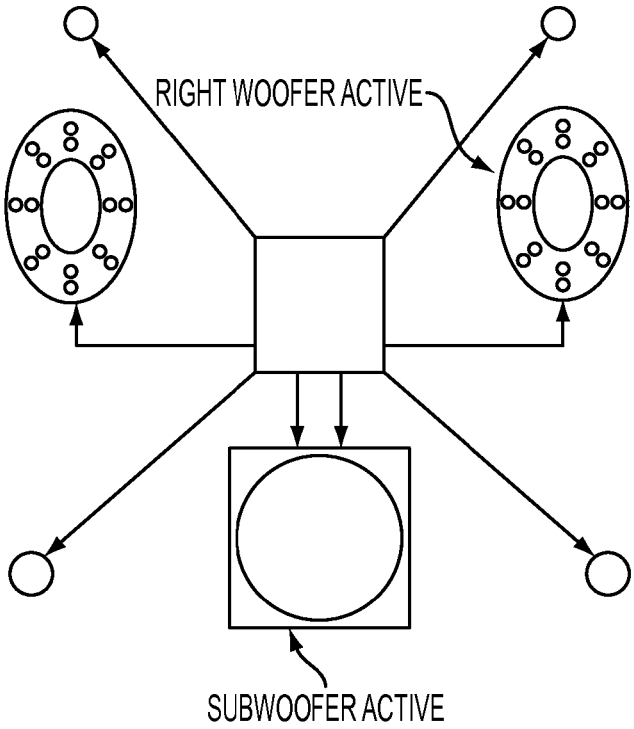
FIGS. 5-7 illustrate operation of a system or method for controlling speaker acoustic output in a multi-speaker audio system having multiple listening zones that includes substantially simultaneously adjusting gain and at least one additional parameter according to various embodiments of the present disclosure.
Figure 5B:
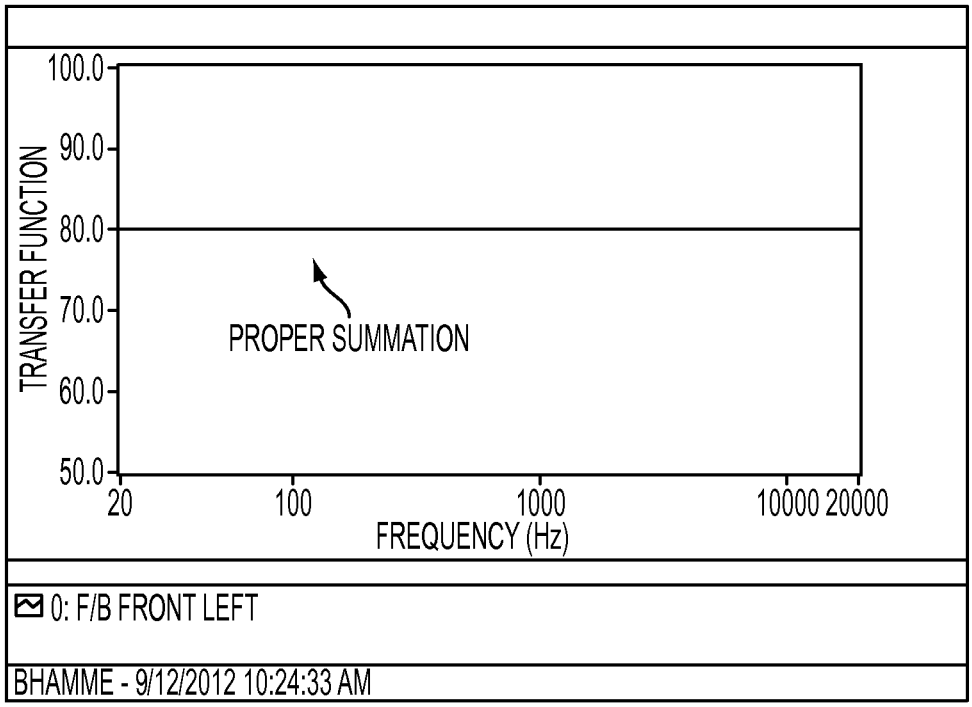

FIGS. 5A and 5B illustrate operation and performance of an audio system incorporating the balance and fade control according to various embodiments of the present disclosure. As illustrated in FIG. 5A, balance and fade control settings have been adjusted to move or bias the sound field toward the front left listening zone. However, the right woofer and subwoofer remain active throughout the majority of the range of the balance and fade controls with the exception of the maximum/minimum setting. This results in proper summation of the audio signals as generally illustrated by the flat frequency response in FIG. 5B.

Figure 6A:
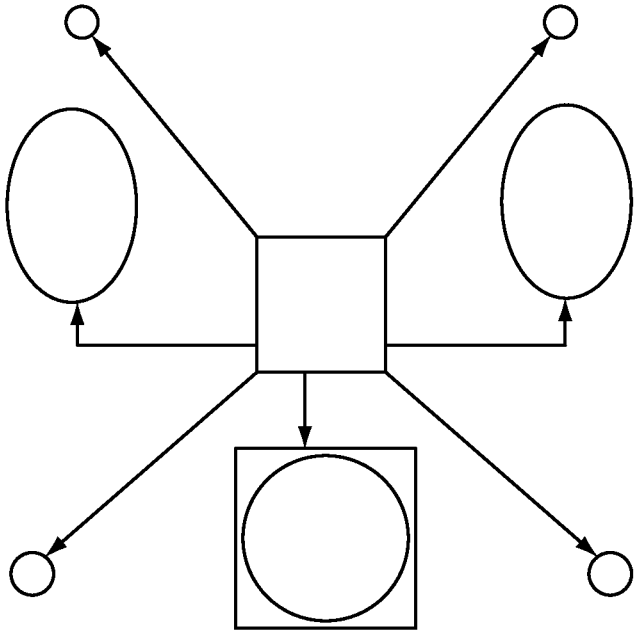
Figure 6B:
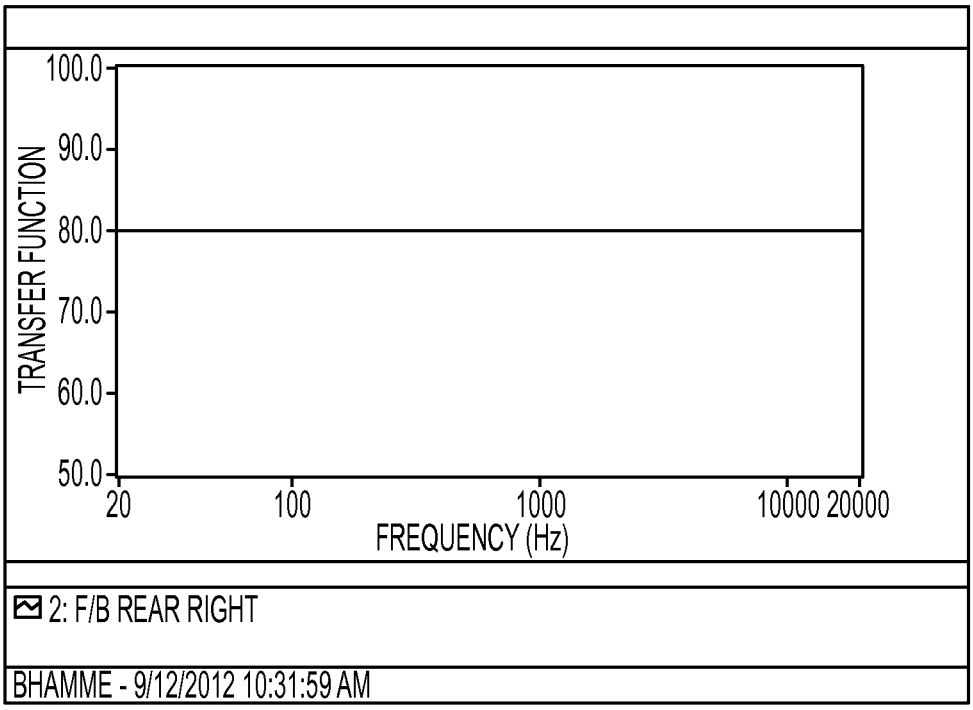

Similarly, FIGS. 6A and 6B illustrate operation and performance of an audio system incorporating the balance and fade control according to embodiments of the present disclosure. As illustrated in FIG. 6A, balance and fade control settings have been adjusted to move or bias the sound field toward the rear right listening zone. However, the subwoofer and right rear speakers remain active throughout the majority of the range of the balance and fade control settings with the exception of the maximum/minimum setting. This results in a generally flat frequency response as illustrated in FIG. 6B corresponding to superior audio quality.

Figures 7, 8:
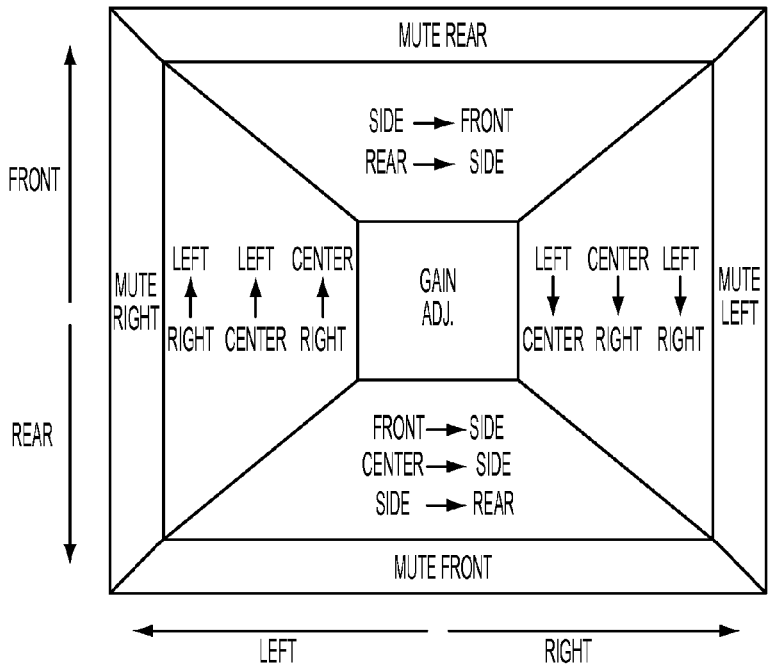
FIG. 8 illustrates operation of a system or method for progressive control of speaker acoustic output with multiple control ranges each having at least one associated control parameter according to various embodiments of the present disclosure.

FIG. 7 is a chart illustrating relative gains applied at the minimum/maximum settings of an audio system incorporating the balance and fade control according to various embodiments of the present disclosure. The detent or default position of the balance and fade controls is represented by the first row in the table of FIG. 7. Representative values for the relative gains applied at the maximum/minimum settings of the balance and fade control ranges are provided for various combinations of the balance and fade controls. The first column designates the listening region or zone with the remaining columns having representative gain values associated with each of the speakers indicated by the column heading.

For example, as previously described, the first row corresponds to the detent or default/center position with no gain/attenuation applied to any of the speakers. The second row corresponds to relative gain/attenuation applied to each speaker to move or shift the sound to the front zone of the listening area. This would be indicated by adjusting the fade control to a maximum (or minimum position) while the balance control remains in a detent position. As such, in this example, a relative gain of −72 dB would be applied to the subwoofer effectively muting the subwoofer. No relative gain adjustments (0 dB) are applied to the front speakers, which include the left front woofer, right front woofer, left front mid, and right front mid. Relative gain values of −72 dB are applied to the left rear mid and right rear mid speakers, and no relative gain (0 dB) is applied to the center mid speaker. In a similar fashion, the last row of FIG. 7 corresponds to moving or shifting the sound to the rear right region of the listening area by adjusting the fade control from its detent to a maximum (or minimum) position/setting corresponding to "rear" and the balance control to a maximum (or minimum) position/setting corresponding to "right". As indicated by the values in the last row, this would result in a relative gain of −36 dB applied to the subwoofer, 0 dB applied to the right rear mid speaker, and −72 dB applied to all other speakers effectively muting all by the right rear mid and the subwoofer.

As illustrated in FIG. 7, the maximum and minimum positions of the balance and fade controls result in significantly more attenuation than the representative prior art audio system as represented in the chart of FIG. 4. This results in effective muting of the non-intended speakers associated with a particular balance and fade control minimum/maximum setting according to the embodiments of the present disclosure in contrast to the prior art implementation where one or more non-intended speakers continue to generate perceptible audio output. As such, operation of the system is consistent with user expectations by muting the speakers that are not associated with a particular listening zone when the corresponding balance and fade controls are set to their respective minimum/maximum position of the control range. As previously described with respect to the block diagram of FIG. 1, in addition to the relative gain settings, at least one additional parameter, such as filtering and/or other signal processing parameters may also be adjusted substantially simultaneously with the relative gain adjustments to provide progressive balance and fade at various control settings for the balance and fade controls with muting or effective muting at the minimum/maximum settings.

As generally illustrated by the relative gain values applied to speakers in a multi-speaker audio system having multiple listening zones, a system or method for controlling speaker acoustic output according to the present disclosure substantially simultaneously adjust gain and at least one additional parameter, such as filtering and/or other signal processing parameters of at least a first speaker relative to at least a second speaker in response to a change in balance and/or fade settings of the audio system across a range of balance and fade settings except for a maximum or minimum setting, and mute at least one speaker in response to the maximum or minimum balance or fade setting. By adjusting at least one additional parameter, such as filtering and/or other signal processing parameters of at least a first speaker relative to at least a second speaker, the systems and methods of the present disclosure maintain a desired sound quality across a range of balance and fade settings except for the maximum and minimum settings, where one or more speakers are muted to meet user expectations in response to a balance or fade setting at a minimum/maximum setting.

FIG. 8 illustrates operation of a system or method for progressive control of speaker acoustic output with multiple control ranges each having at least one associated control parameter according to various embodiments of the present disclosure. While three control ranges or regions are illustrated in the representative embodiment shown, those of ordinary skill in the art will recognize that additional control regions may be provided each having at least one associated audio response characteristic produced by adjusting at least one associated control parameter.

In the representative embodiment illustrated, a first control region is designated by reference numeral 1 and represents balance and fade settings surrounding a detent, default, or middle position. As illustrated in FIG. 8, control settings within region 1 correspond to balance and fade control settings nearest to their detent positions. At full detent, channel levels are tuned to their design or ideal levels, which may be optimized for a particular listening environment. With adjustment away from the detent positions, at least one parameter (gain in this example) is adjusted to achieve audio panning As also shown in FIG. 8, a second control zone surrounds the first control zone and is generally represented by reference numerals 2, 3, and 4. In region 2, the fade control setting has progressed outside of region 1 but is not yet in region 5 (third control zone). At least one parameter (channel mix and channel gain in this example) is adjusted in this control region so that the audio progressively fades toward the front. This is accomplished with channel gain adjustments as well as mixing adjustments so that the side channel mixing shifts toward the front and the rear channel mixing shifts toward the sides. Region 3 has a similar control strategy as region 2, but with the addition of a center channel. In region 3, the fade control has progressed outside of region 1 but is not yet in region 5. At least one parameter is adjusted (gain and mixing in this example) so that the audio is progressively fading toward the rear of the listening environment. This is accomplished with channel gains and mixing so that the front and center channel mixing shifts the virtual sound source toward the sides, and the side channel mixing shifts toward the rear.

In region 4, the balance control has progressed outside of region 1 settings but is not yet in region 5. In this region the parameters, such as gain, filtering, and/or mixing, are controlled to progressively fade to the left or right. This is accomplished with channel gains and also the left or right channels will mix to the right or left, respectively. The center channel will also mix to the left or right in tandem with the left and right channels.

In the third control zone represented by region 5, the balance and fade controls are at a maximum or last available setting. One or more parameters are adjusted such that the audio is completely faded and at least one speaker is muted by corresponding adjustment of the channel gains. For example, the relative gains in addition to filtering and/or additional acoustic parameters may be adjusted substantially simultaneously by the signal processor to progressively shift or fade the acoustic field. The at least one muted or effectively muted (no perceptible audio output) speaker corresponds the particular listening region or zone associated with the minimum/maximum balance/fade settings. For example, a fade to the front as shown in region 5 at the top of FIG. 8 results in muting of the rear speaker(s). Similarly, a setting the balance all the way to the right as shown in region 5 at the right side of FIG. 8 results in muting of the left speaker(s), etc.

As generally described above and illustrated in FIG. 8, systems and methods for controlling balance and fade according to embodiments of the present disclosure may include one or more control regions or ranges surrounding the detent or default position of the balance and fade control interface. In the exemplary embodiment illustrated, a first range of balance and fade settings results in adjusting or modifying at least a first parameter, such as gain, associated with corresponding speakers within the listening environment. A second range of balance and fade settings results in adjusting or modifying at least a second parameter, such as the channel mixing, for example. The control may be implemented such that the second range adjusts both the first and second parameters, or various combinations of the second parameter and other parameters, such as frequency filtering, for example. Multiple control ranges may be provided with each range having progressive adjustments to one or more associated parameters to alter the sound field within the listening environment. In various embodiments, the multiple control ranges include a range, such as represented by region 5 in FIG. 8, that results in muting at least one speaker when the balance or fade is set to the last available position. In one embodiment, the system and method may also include adjusting the non-zero gain of a low frequency speaker, such as a subwoofer, to provide reduced non-directional acoustic output in response to the maximum or minimum balance or fade setting.

As those of ordinary skill in the art will appreciate, balance and fade control according to various embodiments of the present disclosure may be implemented in various types of listening environments and may use a digital signal processor having software and hardware to perform various functions, such as substantially simultaneously adjusting relative gains, filtering, channel mixing, and the like between or among speakers positioned within various regions or zones of the listening environment. In various embodiments, the system or method for balance and fade control is implemented within a head unit or control unit of an audio system in a vehicle having multiple speakers positioned within a vehicle cabin.

Balance and fade control according to embodiments of the present disclosure offers a hybrid approach that operates as expected by listeners and may reduce unnecessary complaints or warranty claims by muting or effectively muting one or more speakers associated with a particular listening region or zone. The systems and methods of the present disclosure maintain a desired sound quality across a range of balance and fade settings except for the maximum and minimum settings, where one or more speakers are muted. In addition, the present disclosure provides a single implementation that achieves both rationales for balance and fade control without modification to existing controls that may vary based on the particular implementation of the human-machine interface (HMI). Muting of one or more speakers can be provided without an additional control, button, knob, switch, etc. The user can fine-tune the soundstage to individual preference by re-positioning the audio within the listening environment over a range of balance and fade settings using all but the maximum/minimum settings, and can also choose to reduce the audio output in certain zones of the listening environment by moving the balance and/or fade controls to the end of their range.

As previously described, operation of the balance and fade controls and the resulting audio system performance according to various embodiments of the disclosure is intuitive and can be transparent to meet user expectations. For example, many users expect some output from each of the loudspeakers with the balance and fade controls near their detent or default positions, and also assume that at least some loudspeakers will have no output as the controls reach a minimum/maximum setting at the end of their range.

While exemplary embodiments are described above, it is not intended that these embodiments describe all possible forms of the claimed subject matter. Rather, the words used in the specification are words of description rather than limitation, and it is understood that various changes may be made without departing from the spirit and scope of the disclosure. Additionally, the features of various implementing embodiments may be combined to form further embodiments that are not explicitly shown or described. While various embodiments may have been described as providing advantages or being preferred over other embodiments or prior art implementations with respect to one or more desired characteristics, as one of ordinary skill in the art is aware, one or more features or characteristics may be compromised to achieve desired overall system attributes, which depend on the specific application and implementation. These attributes include, but are not limited to: cost, strength, durability, life cycle cost, marketability, appearance, packaging, size, serviceability, weight, manufacturability, ease of assembly, etc. Embodiments described as less desirable than other embodiments or prior art implementations with respect to one or more characteristics are not outside the scope of the disclosure and may be desirable for particular applications.

What is claimed is:

1. A system for controlling speaker acoustic output in a multi-speaker audio system having multiple listening zones, comprising:

a first speaker and a second speaker;

an audio signal processor configured to substantially simultaneously adjust gain and at least one additional acoustic parameter of at least the first speaker relative to at least the second speaker in response to a change in balance or fade settings of the audio system across a range of balance and fade settings, except for a maximum or minimum balance or fade setting, and mute at least one speaker in response to the maximum or minimum balance or fade setting; and wherein the audio signal processor is further configured to adjust gain of a subwoofer to a non-zero gain in response to the maximum or minimum balance or fade setting.

2. The system of claim 1 wherein the audio signal processor comprises a spectral manager configured to adjust frequency responses for the first and second speakers and wherein the gain is adjusted upstream of the spectral manager to provide a desired summation of speaker acoustic outputs within a designated listening zone.

3. The system of claim 1 wherein the first and second speakers are mounted within a vehicle cabin.

4. The system of claim 1 wherein the audio signal processor is configured to mute at least one speaker by adjusting the gain of the at least one speaker so that the speaker does not produce a perceptible audio output.

5. The system of claim 1 wherein the first and second speakers comprise mid-range speakers positioned at left and right regions of a front zone of a listening environment, the system further comprising:

third and fourth mid-range speakers positioned at left and right regions of a rear zone of the listening environment;

a subwoofer positioned in the rear zone of the listening environment; and wherein the audio signal processor is configured to mute the third and fourth mid-range speakers and adjust gain of the subwoofer to provide a non-zero signal to the subwoofer in response to a minimum or maximum fade setting.

6. The system of claim 1 wherein the first and second speakers comprise mid-range speakers positioned at left and right regions of a front zone of a listening environment, the system further comprising:

third and fourth mid-range speakers positioned at left and right regions of a rear zone of the listening environment; a subwoofer positioned in the rear zone of the listening environment; and wherein the audio signal processor is configured to mute the first and third mid-range speakers and adjust gain of the subwoofer to provide a non-zero signal to the subwoofer in response to a minimum or maximum balance setting.

7. The system of claim 1 wherein the first and second speakers comprise mid-range speakers positioned at left and right regions of a front zone of a listening environment, the system further comprising:

third and fourth mid-range speakers positioned at left and right regions of a rear zone of the listening environment; a subwoofer positioned in the rear zone of the listening environment; and wherein the audio signal processor is configured to mute the second, third, and fourth mid-range speakers and adjust gain of the subwoofer to provide a non-zero signal to the subwoofer in response to a minimum balance setting and a minimum fade setting.

8. A method for controlling speaker acoustic output in a multi-speaker audio system having at least a first speaker and at least a second speaker arranged in multiple listening zones, comprising:

substantially simultaneously adjusting gain and at least one additional acoustic parameter of at least the first speaker relative to at least the second speaker in response to a change in balance or fade settings of the audio system across a range of balance and fade settings, except for a maximum or minimum balance or fade setting, adjusting gain of a subwoofer to a non-zero gain in response to the maximum or minimum balance or fade setting, and muting at least one speaker in response to the maximum or minimum balance or fade setting.

9. The method of claim 8 wherein muting at least one speaker comprises adjusting gain of the at least one speaker so that the at least one speaker produces no audio output.

10. The method of claim 8 wherein the first and second speakers comprise mid-range speakers positioned at left and right regions of a front zone of a listening environment, the system further including third and fourth mid-range speakers positioned at left and right regions of a rear zone of the listening environment and the subwoofer positioned in the rear zone of the listening environment, the method further comprising: muting the third and fourth mid-range speakers and adjusting gain of the subwoofer to provide a non-zero signal to the subwoofer in response to a minimum or maximum fade setting.

11. The method of claim 8 wherein the first and second speakers comprise mid-range speakers positioned at left and right regions of a front zone of a listening environment, the system further including third and fourth mid-range speakers positioned at left and right regions of a rear zone of the listening environment and the subwoofer positioned in the rear zone of the listening environment, the method further comprising: muting the first and third mid-range speakers and adjusting gain of the subwoofer to provide a non-zero signal to the subwoofer in response to a minimum or maximum balance setting.

12. The method of claim 8 wherein the first and second speakers comprise mid-range speakers positioned at left and right regions of a front zone of a listening environment, the system further including third and fourth mid-range speakers positioned at left and right regions of a rear zone of the listening environment and the subwoofer positioned in the rear zone of the listening environment, the method further comprising: muting the second, third, and fourth mid-range speakers and adjusting gain of the subwoofer to provide a non-zero signal to the subwoofer in response to a minimum or maximum balance setting and a minimum or maximum fade setting.

13. A system for controlling balance and fade in a multi-speaker listening environment having a plurality of speakers and a control interface including balance and fade controls having a plurality of control ranges surrounding a detent position of the balance and fade controls, comprising:

a plurality of speakers including at least one subwoofer, an audio signal processor configured to adjust at least a first audio parameter for a first range of balance and fade control settings of the plurality of speakers, to adjust at least a second audio parameter different from the first audio parameter in response to a second range of balance and fade settings, to adjust gain of the subwoofer to a non-zero gain in response to the maximum or minimum balance or fade setting, and to mute at least one speaker of the plurality of speakers in response to a third range of balance and fade settings.

14. The system of claim 13 wherein the audio signal processor is further configured to adjust the first and the second audio parameters in response to the second range of balance and fade settings.

15. The system of claim 13 wherein the first audio parameter comprises gain and the second audio parameter comprises channel mixing.

16. The system of claim 13 wherein the audio signal processor is further configured to mute at least one speaker only in response to either the balance control or the fade control being set to a corresponding last available control setting.

* * * * *